United States Patent [19]

Blaskowski

[11] 4,173,808

[45] Nov. 13, 1979

[54] SOOT BLOWER FOR TUBE BUNDLE IN PRESSURIZED ENCLOSURE

[75] Inventor: Henry J. Blaskowski, West Simsbury, Conn.

[73] Assignee: Combustion Engineering, Inc., Windsor, Conn.

[21] Appl. No.: 1,341

[22] Filed: Jan. 5, 1979

[51] Int. Cl.[2] ..... F23J 3/02; F27D 23/00

[52] U.S. Cl. ..... 15/316 R

[58] Field of Search ..... 15/316 R, 316 A, 317, 15/318

[56] References Cited

U.S. PATENT DOCUMENTS

| | | | |
|---|---|---|---|
| 1,139,911 | 5/1915 | Shepler et al. | 15/316 R |
| 1,557,792 | 10/1925 | Bayer | 15/317 |
| 1,571,039 | 1/1926 | Bayer | 15/318 |
| 1,645,307 | 10/1927 | Snow | 15/318 |
| 1,928,090 | 9/1933 | Bowers | 15/316 R |
| 2,066,014 | 12/1936 | Pfleider | 15/317 |
| 3,816,871 | 6/1974 | Karnofsky | 15/317 |

*Primary Examiner*—Christopher K. Moore
*Attorney, Agent, or Firm*—Wayne H. Lang

[57] ABSTRACT

A soot blower for use in a tubular heat exchanger, gasifier or reactor that is installed in parallel alignment with a bundle of elongate tubes therein. The soot blower is adapted to eject a jet of steam radially over the outer surface of said tubes to remove deposits therefrom. The steam jet may be moved axially to progressively clean the length of the tubes and the operation of the soot blower may be activated or terminated without interfering with fluid flow over or through said tubes.

8 Claims, 1 Drawing Figure

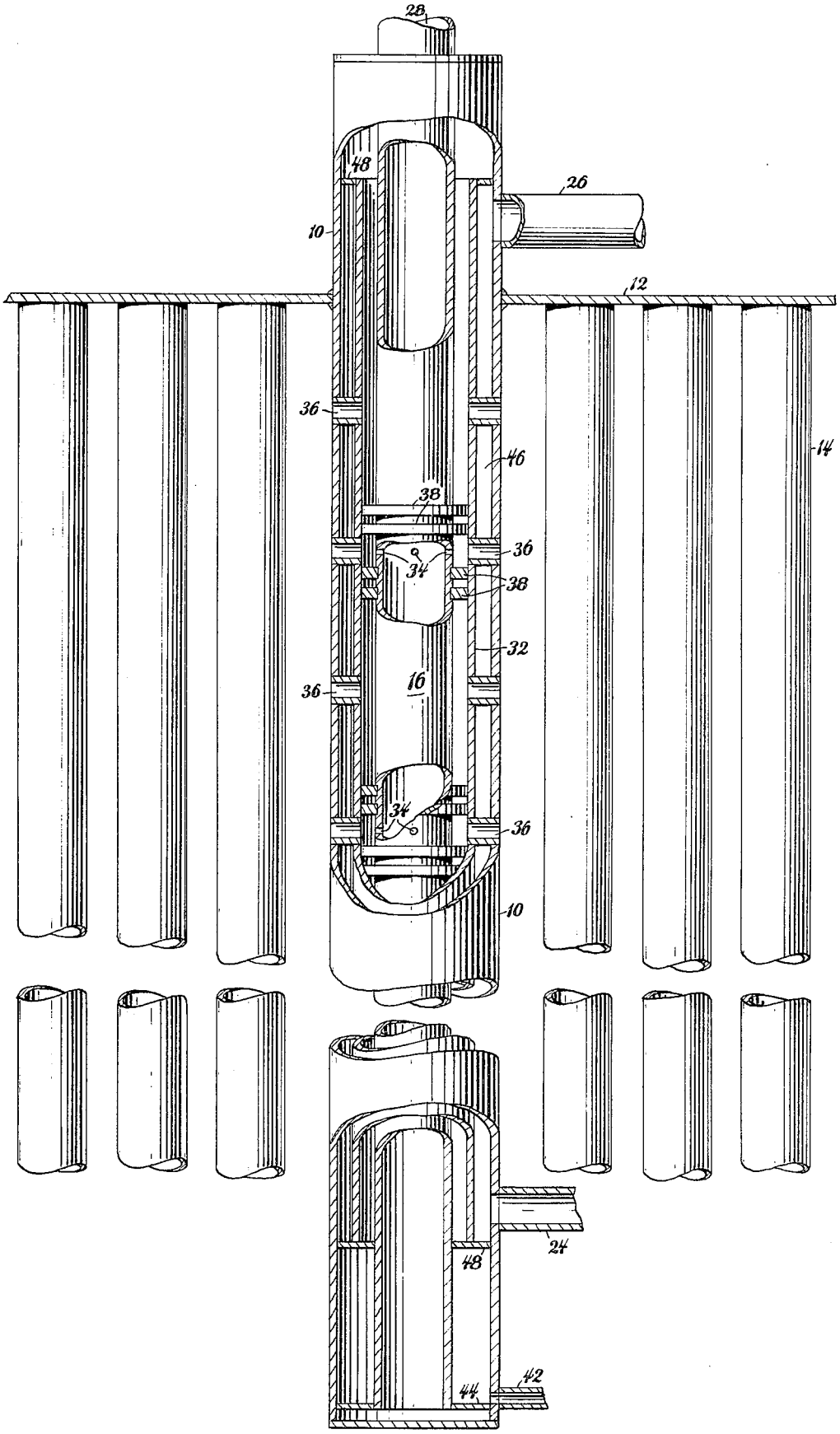
28
48
26
10
12
36
46
14
38
36
34
38
32
16
36
34
36
10
24
48
42
44

SOOT BLOWER FOR TUBE BUNDLE IN PRESSURIZED ENCLOSURE

BACKGROUND OF THE INVENTION

The present invention relates to a soot blower for use in a tubular heat exchanger wherein a blast of cleaning fluid such as steam is projected laterally from said soot blower over the tubes of said heat exchanger to remove deposits therefrom. Usually a soot blower itself is adapted to extend laterally through a side wall of a heat exchanger normal to a bank of tubes therein in order that a jet of cleaning fluid being ejected therefrom will pass over the tubes to be cleaned. In the case of a very long tube bank containing a dense array of tubes it is not possible to install conventional soot blowers because there is insufficient room between tubes.

SUMMARY OF THE INVENTION

This invention therefore provides for a tubular soot blower that extends through an end wall into a tube bundle of a tubular heat exchanger, parallel to the several tubes thereof. The soot blower tube is a permanent element that is positioned to provide a minimum of interference to the flow of fluid over the other of said tubes.

BRIEF DESCRIPTION OF THE DRAWING

The single FIGURE of the drawing depicts a side elevation of a soot blower for an elongate tubular heat exchanger constructed in accordance with the present invention.

DESCRIPTION OF A PREFERRED EMBODIMENT

In the drawing a soot blower tube 10 extends through an end wall 12 of a housing and extends parallel to other tubes 14 of a tube bundle contained in an economizer or other tube type heat exchanger. The tube 10 extends between an inlet and outlet header and is provided with suitable ducting that permits a cooling fluid to enter inlet 24 and pass upward through the tube to an outlet 26. Positioned within this tube is an inner soot blower or steam carrying tube 28 connected to an outside source of steam not here shown. The tube 28 is vertically movable with respect to the outer tube 10. The inlet end of tube 28 slidably traverses an apertured end of outer tube 10, while the opposite end of inlet tube 28 is concentrically supported by an annular member 44 that slides on the inner surface of tube 10 when tube 16 is telescopically reciprocated.

An intermediate tube 32 is placed between tubes 10 and 28 to provide a generally close fit for the telescopically mounted tube 28, while the intermediate tube 32 and the outer tube 10 are spaced apart to form an annular passageway 46 therebetween that is closed by end walls 48 to contain the cooling fluid flowing between inlet port 24 and outlet port 26.

A series of radially disposed openings 34 are provided in tube 28 to permit the exhaust of steam or other cleaning fluid coming from the outside source. The openings 34 of the tube 28 are adapted to become aligned with radial passageways 36 that extend between tubular members 32 and 10 when the tube 28 is moved axially.

The radial passageways 36 may be axially spaced along the longitudinal axis of the tube 10 in order that cleaning fluid may be ejected therefrom over the outer surface of adjacent tubes 14 at a number of locations determined by the positioning of openings 34 of the inner tube 28. Instead of providing but a single series of radial openings 34 in tube 28, similar openings 34 may be placed at two or more axially spaced locations along the longitudinal axis of tube 28 whereby cleaning fluid may be ejected either sequentially or simultaneously along the axis of the tube. If several axially spaced locations are to be cleaned simultaneously, the axial spacing between openings 34 is two or three times that which lies between radial passageways 36 whereby axial movement of tube 28 a predetermined distance brings openings 34 into engagement with a set of radial passageways 36, and further movement of tube 28 for the same distance will move openings 34 into engagement with a different set of radial passageways whereby a blast of cleaning fluid from an outside will be exhausted through aligned openings.

Sealing means in the form of split rings or "O" rings 38 or their equivalent are positioned around the inner steam tube 28 at opposite sides of openings 34 in the annular space between tubes 28 and 32 to prevent leakage of cleaning fluid therebetween, however a drain 42 is provided at the lower end of outer tube 10 to permit drainage therefrom of any fluid that may leak past the rings 38. The rings 38 are adapted to seat in the inner tube 28 and move axially along with the inner tube 28 when it is axially re-positioned by any given actuator.

The inner tube 28 is usually moved to align openings 34 with passageways 36 by means of an automatic actuator responsive to any of several variable conditions although a manually operated mechanical device may be utilized without departing from the spirit of the invention.

The present invention is particularly adapted for insertion parallel to the tubes in a heat exchanger containing an array of closely spaced tubes in the bundle wherein it would be impossible to insert a soot blower normal to the tubes. However, the cleaning means defined herein may also be utilized in an economizer, superheater or other apparatus having a tube bank or bundle of elongate tubes that require the removal of deposits from the outer surface thereof.

What is claimed is:

1. A soot blower for removal of deposits from the outside surface of a bundle of elongate tubes, said soot blower comprising an elongate outer tube lying parallel to the tubes of said tube bundle and having an apertured end and a closed end, an inlet duct for cooling fluid connected to one end of the outer tube and an outlet duct for cooling fluid connected to the opposite end of the outer tube, and intermediate tube positioned concentrically within the outer tube to define an annular cooling space connected to the inlet and outlet ducts, radial passageways extending between the intermediate and outer tubes to bridge the annular cooling space therebetween, a central soot blower tube axially movable within the intermediate tube having an inlet end thereof traversing the apertured end of the outer tube, a source of cleaning fluid connected to the inlet end of the soot blower tube, and radial openings in the soot blower tube adapted to coincide with the radial passageways that extend between the intermediate and outer tubes to project cleaning fluid radially therethrough when the soot blower tube is moved axially.

2. A soot blower as defined in claim 1 wherein radial passageways between the intermediate and outer tubes are positioned at a plurality of axially spaced locations along the longitudinal axis of the tube.

3. A soot blower as defined in claim 2 wherein openings in the soot blower tube are spaced along the longitudinal axis of the tube.

4. A soot blower as defined in claim 3 wherein the axial spacing of openings in the central soot blower tube are at least two times the axial spacing of radial passageways that extend between the intermediate tube and the outer tube to provide sequential engagement of the openings and the passageways.

5. A soot blower as defined in claim 4 including an annular sealing means surrounding the soot blower tube and adapted to bridge the space between the soot blower tube and the intermediate tube to prevent leakage of fluid into the space therebetween.

6. A soot blower as defined in claim 5 wherein the annular sealing means comprises a split ring that extends around the soot blower tube on axially spaced sides pf the radial openings therein.

7. A soot blower as defined in claim 6 including an annular baffle connected to the end portion of the central soot blower tube adapted to slidably abut the inner surface of the outer tube when the central tube is moved axially.

8. A soot blower as defined in claim 7 including vent means in the outer tube adjacent the end of the intermediate tube that permits the drainage of fluid therefrom.

* * * * *